United States Patent [19]

Council et al.

[11] Patent Number: 4,705,107

[45] Date of Patent: Nov. 10, 1987

[54] APPARATUS AND METHODS FOR CLEANING A WELL

[75] Inventors: Malcolm N. Council, Richardson; Walter Baker, Lewisville, both of Tex.

[73] Assignee: Otis Engineering Corporation, Dallas, Tex.

[21] Appl. No.: 861,417

[22] Filed: May 9, 1986

Related U.S. Application Data

[63] Continuation-in-part of Ser. No. 743,573, Jun. 11, 1985, abandoned.

[51] Int. Cl.[4] ..... E21B 37/02; B08B 9/02

[52] U.S. Cl. ..... 166/170; 166/223; 175/408; 15/104.12; 15/104.14

[58] Field of Search ..... 166/170, 177, 222, 223, 166/384; 175/107, 406, 408; 15/104.1 R, 104.12, 104.13, 104.14

[56] References Cited

U.S. PATENT DOCUMENTS

| | | | |
|---|---|---|---|
| 526,997 | 10/1984 | Forsyth et al. | 15/104.14 X |
| 761,586 | 5/1904 | Hart | 15/104.12 |
| 775,679 | 11/1904 | Nowotny | 15/104.12 X |
| 812,361 | 2/1906 | Pickles et al. | 15/104.12 X |
| 854,819 | 5/1907 | Georges et al. | 15/104.13 |
| 942,312 | 12/1909 | Darlington | 15/104.12 |
| 1,634,591 | 7/1927 | McGeehin | 15/104.12 |
| 1,658,697 | 2/1928 | Wiesman | 166/223 X |
| 1,705,451 | 3/1929 | Taricco | 15/104.14 |
| 2,089,597 | 8/1937 | Carter | 15/104.12 |
| 2,178,801 | 11/1939 | Mattern et al. | 175/406 X |
| 2,201,680 | 5/1940 | Haynes | 166/170 X |
| 3,154,147 | 10/1964 | Lanmon, II | 166/240 |
| 3,285,485 | 11/1966 | Slator | 166/77 X |
| 3,313,346 | 4/1967 | Cross | 166/77 X |
| 3,559,905 | 2/1971 | Polynchuk | 166/77 X |
| 3,703,104 | 11/1972 | Tamplen | 166/240 |
| 3,720,264 | 3/1973 | Hutchison | 166/311 |
| 3,791,447 | 2/1974 | Smith et al. | 166/311 |
| 3,811,499 | 5/1974 | Hutchison | 166/67 |
| 3,829,134 | 8/1974 | Hutchison | 285/14 |
| 3,850,241 | 11/1974 | Hutchison | 166/222 |
| 4,011,100 | 3/1977 | Ross | 15/104.12 X |
| 4,088,191 | 5/1978 | Hutchison | 166/223 |
| 4,333,527 | 6/1982 | Higgins et al. | 166/117.5 |
| 4,349,073 | 9/1982 | Zublin | 166/73 X |
| 4,355,685 | 10/1982 | Beck | 166/240 |
| 4,441,557 | 4/1984 | Zublin | 166/223 |
| 4,442,899 | 4/1984 | Zublin | 166/222 X |
| 4,625,799 | 12/1986 | McCormick et al. | 166/223 |

FOREIGN PATENT DOCUMENTS

| | | | |
|---|---|---|---|
| 177277 | of 1901 | Fed. Rep. of Germany | 15/104.12 |
| 198771 | 6/1908 | Fed. Rep. of Germany | 15/104.12 |
| 2712876 | 10/1978 | Fed. Rep. of Germany | 15/104.12 |
| 1245439 | 9/1971 | United Kingdom . | |
| 1282392 | 7/1972 | United Kingdom . | |
| 1415889 | 12/1975 | United Kingdom . | |

OTHER PUBLICATIONS

Elliott Company, Bulletin Y-100, 1979.

*Primary Examiner*—Stephen J. Novosad
*Assistant Examiner*—John F. Letchford
*Attorney, Agent, or Firm*—Thomas R. Felger

[57] ABSTRACT

A system for cleaning wells with coil tubing, a fluid motor and cutter heads. The invention allows equipment used to clean boiler tubes or heat exchangers to effectively remove downhole deposits from the inside diameter of well tubulars.

12 Claims, 7 Drawing Figures

APPARATUS AND METHODS FOR CLEANING A WELL

This is a continuation-in-part of our pending U.S. patent application Ser. No. 06/743,573 filed June 11, 1985 now abandoned.

BACKGROUND OF THE INVENTION

1. Field of the Invention

This invention relates to the servicing of wells by use of coil tubing and more particularly to removal of scale and other downhole deposits from the inside diameter of well tubulars.

2. Description of the Prior Art

It has been common practice for many years to run a continuous reeled pipe (known extensively in the industry as "coil tubing") into a well to perform operations utilizing the circulation of treating fluids such as water, oil, acid, corrosion inhibitors, cleanout fluids, hot oil, and the like fluids. Coil tubing being continuous, rather than jointed, is run into and out of a well with continuous movement of the tubing through use of a coil tubing injector.

Coil tubing is frequently used to circulate cleanout fluids through a well for the purpose of eliminating sand bridges, scale, or other downhole deposit obstructions. Often such obstructions are very difficult and occasionally impossible to remove because of the inability to rotate the coil tubing to drill out such obstructions. Turbo-type drills have been used but have been found to develop insufficient torque for many jobs.

Thus, it is desirable to perform drilling operations in wells through use of coil tubing which can be run into and removed from a well quickly in addition to performing the usual operations which require only the circulation of fluids.

U.S. Pat. No. 3,285,485 which issued to Damon T. Slator on Nov. 15, 1966 discloses a device for handling tubing and the like. This device is capable of injecting reeled tubing into a well through suitable seal means, such as a blowout preventer or stripper, and is currently commonly known as a coil tubing injector.

U.S. Pat. No. 3,313,346 issued Apr. 11, 1967 to Robert V. Cross and discloses methods and apparatus for working in a well using coil tubing.

U.S. Pat. No. 3,559,905 which issued to Alexander Palynchuk on Feb. 2, 1971 discloses an improved coil tubing injector.

High pressure fluid jet systems have been used for many years to clean the inside diameter of well tubulars. Examples of such systems are disclosed in the following U.S. Pat. Nos.:

| | | |
|---|---|---|
| 3,720,264 | 3,850,241 | 4,442,899 |
| 3,811,499 | 4,088,191 | |
| 3,829,134 | 4,349,073 | |

Outside the oil and gas industry, tubing cleaners have been used for many years to remove scale and other deposits from the inside diameter of tubes used in heat exchangers, steam boilers, condensers, etc. Such deposits may consist of silicates, sulphates, sulphides, carbonates, calcium, and organic growth. Tubing cleaners and associated equipment are disclosed in Elliot tubing cleaners bulletin Y-100 1580F-second edition. This bulletin is incorporated by reference for all purposes within this application. Elliot Company is a division of Carrier Corporation, a subsidiary of United Technologies Corporation.

The preceding patents are incorporated by reference for all purposes within this application.

SUMMARY OF THE INVENTION

The present invention is directed towards improved methods and apparatus for cleaning well tubulars using coil tubing.

One object of the invention is to provide a high speed, fluid-powered cutter head to remove scale and other deposits from the inside diameter of a well tubular.

Another object of the present invention is to provide guide means to prevent the cutter head from becoming fouled with other downhole well tools.

A further object of the present invention is to provide sleeve means to centralize the universal joint connecting the fluid motor with the cutter heads and avoid fouling with downhole tools.

A still further object of the present invention is to provide a combination cutter and guide means with improved ability to remove all types of downhole deposits.

Additional objects and advantages of the present invention will be readily apparent to those skilled in the art after studying the written description in conjunction with the drawings and claims.

DESCRIPTION OF THE PREFERRED EMBODIMENTS

Figures 1, 2, 3:
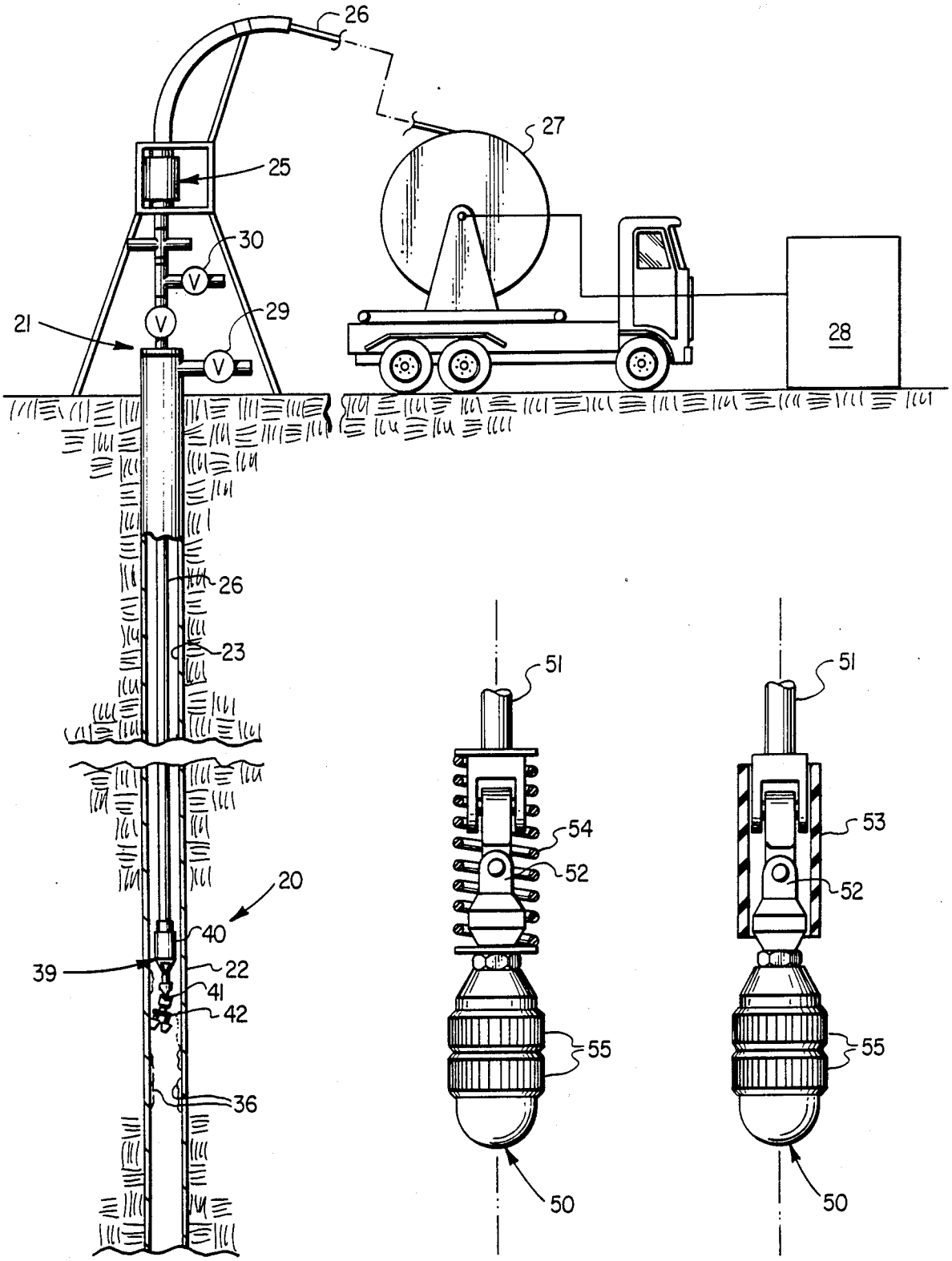
FIG. 1 is a schematic drawing partially in elevation and partially in section with portions broken away showing a coil tubing unit and tubing cleaner removing deposits from the inside diameter of a well tubular.
FIG. 2 is an enlarged drawing partially in section and partially in elevation showing guide means to prevent the tubing cleaner from becoming fouled with other downhole well tools.
FIG. 3 is schematic drawing partially in elevation and partially in section showing alternative guide means to prevent the tubing cleaner from becoming fouled with other downhole well tools.

In FIG. 1 well 20 extends from wellhead 21 to an underground hydrocarbon or fluid producing formation (not shown). Well 20 is defined in part by casing string or well flow conductor 22. This embodiment will be described with respect to casing 22. However, the present invention can be used with other types of well tubulars or flow conductors including liners and production tubing strings. Also, the present invention is not limited to use in oil and gas wells.

During the production of formation fluids, various types of deposits may accumulate on the inside diameter of the well tubulars. Examples of soft deposits are clay, paraffin, and sand. Examples of hard deposits are silicates, sulphates, sulphides, carbonates and calcium. The present invention is particularly useful for removal of hard deposits found in some geothermal and oil wells but may be satisfactorily used to remove other types of deposits.

Using conventional well servicing techniques, injector 25 can be mounted on wellhead 21. Continuous or coil tubing 26 from reel 27 is inserted by injector 25 into bore 23 of casing 22. Tubing cleaner assembly 39 is attached to the lower end of coil tubing 26. Manifold 28 includes the necessary pumps, valves, and fluid reservoirs to discharge power fluid into bore 23 via coil tubing 26. Valves 29 and 30 can be used to control the return of spent power fluid to the well surface.

Fluid motor 40 is attached to the extreme end of coil tubing 26 disposed in casing 22. Fluid motor 40 is mechanically connected to cutter heads 42 by universal joint 41. Motor 40, universal joint 41, and cutter heads 42 are commercially available from Elliot Company. Deposits 36 can be removed from the inside diameter of casing 22 by inserting coil tubing 26 with tubing cleaner assembly 39 including motor 40 and cutter head 42 attached thereto to the desired downhole location. Power fluid from manifold 28 is supplied to motor 40 via coil tubing 26 to rotate cutter heads 42 at a relatively high rate of speed. High speed is particularly useful in removing hard deposits. Power fluid discharged from motor 40 is returned to the well surface via valves 29 or 30.

Many well completions have deviated well tubulars and/or downhole well tools which might restrict longitudinal movement of cutter head 42 throughout the length of the well bore. An example of such a tool is a side pocket gas lift mandrel (not shown). This downhole tool typically has a main bore extending longitudinally therethrough compatible with the bore of the well tubular. A second, smaller bore is offset from the main bore to provide a receptacle for gas lift valves. Cutter heads 42 might become fouled in this offset bore. An example of a side pocket mandrel is shown in U.S. Pat. No. 4,333,527 incorporated by reference for all purposes within this application.

FIGS. 2 and 3 show guide means 50 which can be attached to cutter heads 42 by flexible shaft 51 and universal joint 52. Preferably, flexible shaft 51 extends downwards from cutter heads 42 with guide means 50 positioned therebelow. Guide means 50 is selected to be compatible with the main bore of the well tubular which cutter heads 42 will clean but larger than any offset bore or potential restriction that cutter head 42 might encounter downhole. Thus, guide means 50 will prevent the fouling of cutter head 42 in such restrictions.

Depending upon the type of deposit to be cleaned and other downhole conditions, universal joint 52 may be subject itself to fouling in other downhole tools. In FIG. 2, rubber sleeve 53 is disposed around universal joint 52 to centralize joint 52 and the tools attached thereto while being lowered through well flow conductor 22. When motor 40 is operating, sleeve 53 allows limited flexing of joint 52. In FIG. 3, spring 54 is disposed around the exterior of universal joint 52 for this same purpose. The use of either rubber sleeve 53 or spring 54 will be contingent on the anticipated downhole environment.

Guide means 50 will rotate due to the mechanical connection with cutter head 42 by flexible drive shaft 51. Teeth or serrations 55 may be formed on the exterior of guide means 50 to initially remove a portion of deposits 36 prior to engagement by cutter head 42.

ALTERNATIVE EMBODIMENT

Figure 4:
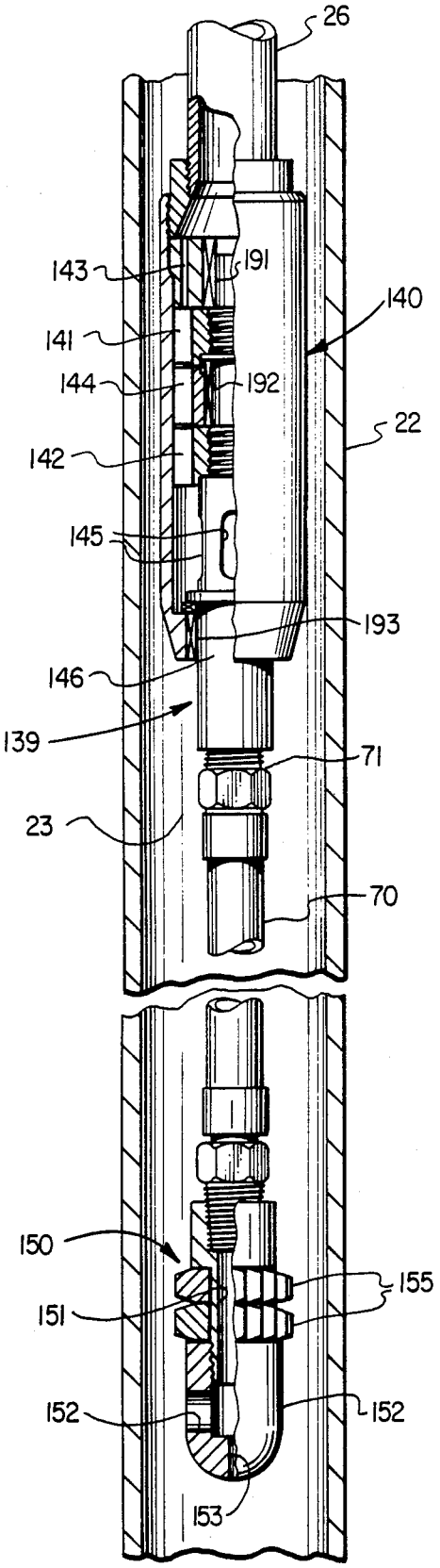
FIG. 4 is a schematic drawing partially in elevation and partially in section with portions broken away showing a tubing cleaner having a fluid motor, hose, and cutter/guide means.

An alternative tubing cleaner assembly 139 is shown in FIG. 4 attached to the lower end of coil tubing 26. Tubing cleaner assembly 139 includes fluid motor 140, hose 70 and combination cutter/guide means 150. Fluid motor 140 preferably includes two fluid-powered turbines 141 and 142 to take maximum advantage of the energy available in the power fluid supplied by coil tubing 26. Power fluid flows from coil tubing 26 through multiple ports 143 and contacts first turbine 141. Power fluid continues through fixed stator 144 and then contacts second turbine 142. A plurality of openings 145 are provided in hollow drive shaft 146 to allow spent power fluid to exit from second turbine 142. Various bearings 191, 192, and 193 are provided in motor 140 to allow rotation of drive shaft 146 and attached turbines 141 and 142. Some components in motor 140 are commercially available from various sources including the Elliot Company.

Flexible hose 70 is attached to hollow drive shaft 146 by threaded connection 71. Hose 70 and combination cutter/guide means 150 rotate in unison with drive shaft 146. Cutter/guide means 150 is similar to previously described guide means 50. The principal differences are flow path 151 and exit ports 152 and 153 which allow spent power fluid to flow from hose 70 through cutter/guide means 150. Serrations 155 are provided on the exterior of cutter/guide means 150 to remove deposits from the interior of well flow conductor 22. The efficiency of serrations 155 is greatly increased by having spent power fluid from exit ports 152 flow upwardly therepast. The power fluid flow path of tubing cleaner assembly 139 optimizes both the rotational effect of serrations 155 and the lifting of loosened deposits by spent power fluid to the well surface. For well cleaning operations involving soft deposits, exit ports 152 can be designed to produce a jetting effect as spent power fluid leaves guide means 150. This jetting effect will remove soft deposits before they can foul serrations 155.

Hose 70 may be selected from many commercially available products including flexible steel hoses as well as elastomeric hoses. Hose 70 must be selected to withstand wear on its exterior associated with rotating inside well flow conductor 22.

Figure 5:
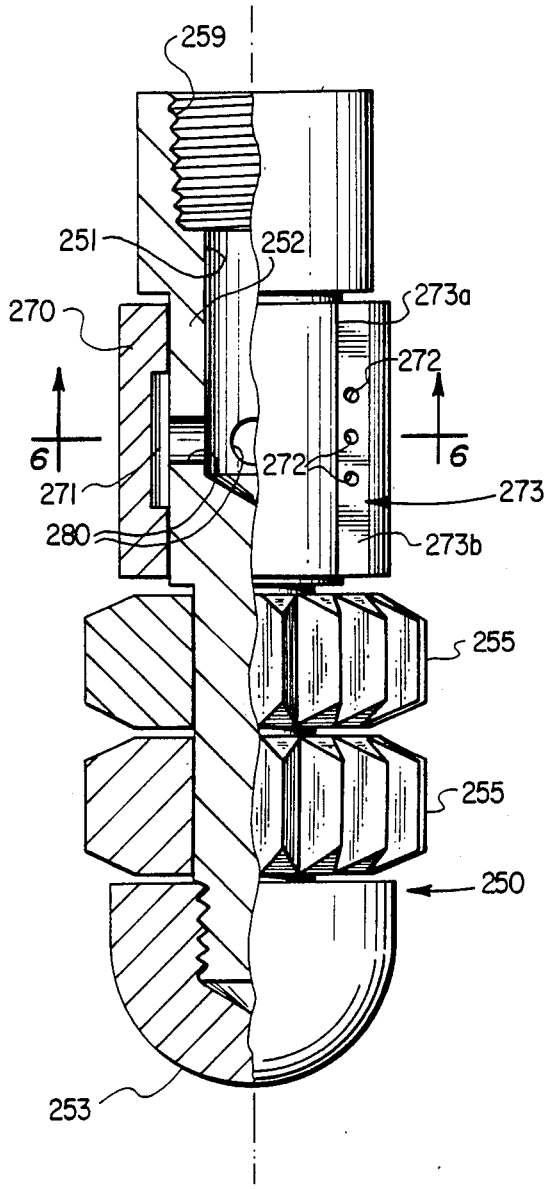
FIG. 5 is an enlarged schematic drawing partially in elevation and partially in section with portions broken away showing a guide means with an alternative fluid flow path.

An alternative cutter/guide means 250 is shown in FIG. 5. Cutter/guide means 250 is attached to and rotated by hose 70 in the same manner as previously described cutter/guide means 150. Cutter/guide means 250 includes mandrel means 252, end cap 253, housing means 270, and serrations 255. Mandrel means 252 has flow path 251 extending partially therethrough with threads 259 formed in flow path 251 to allow attachment of cutter/guide means 250 to hose 70. Flow path 251 extends only partially through the length of cutter/guide means 250 as compared to flow path 151. A plurality of ports 280 extend radially from flow path 251 above serrations 255.

Figure 6:
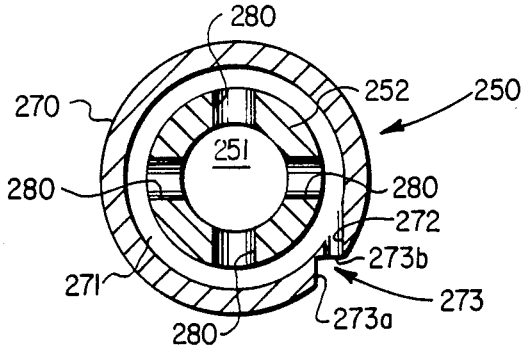
FIG. 6 is drawing in section taken along line 6—6 of FIG. 5.
Figure 7:
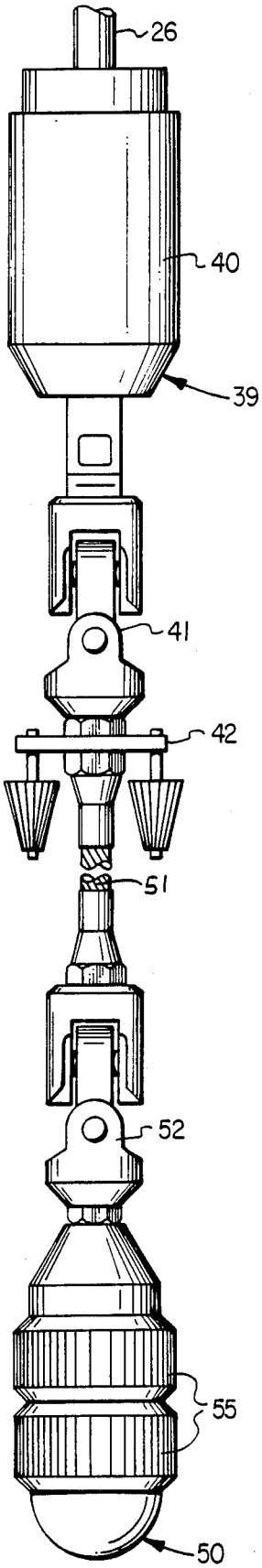
FIG. 7 is a schematic drawing in elevation showing a tubing cleaner with guide means attached thereto.

Housing means 270 is disposed around the exterior of mandrel means 252 and covers ports 280. Annular chamber 271 is formed between the exterior of mandrel means 252 and the interior of housing means 270 to receive spent power fluid from ports 280. As best shown in FIG. 6, a portion of the exterior of housing means 270 has been removed by machining longitudinal groove 273 partially therethrough. A plurality of openings 272 extend from groove 273 to tangentially intersect chamber 271. Groove 273 has surfaces 273*a* and 273*b* perpendicular to each other. Openings 272 are machined normal to surface 273*b*. The result is that spent power fluid can flow from hose 70 through flow path 251 and ports 280 into annular chamber 271. Openings 272 allow spent power fluid to exit from chamber 271 at a tangent relative to the outer surface of mandrel means 252. Exhausting spent power fluid in this manner will cause increase oscillation of cutter/guide means 250 within well flow conductor 22. Openings 272 can also be designed to produce a jet spray as power fluid exits housing means 270. A jet spray may be desirable to remove soft deposits.

Serrations 255 are shown disposed on the exterior of mandrel means 252 below housing means 270. The relative longitudinal position of serrations 255 and housing means 270 could be modified as taught by cutter/guide means 150. End cap 253 is used to hold serrations 255 and housing means 270 on the exterior of mandrel means 252.

The previous description is illustrative of only some embodiments of the present invention. Those skilled in the art will readily see other variations and modifications without departing from the scope of the invention as defined in the claims.

We claim:

1. A system for cleaning the inside diameter of well tubulars comprising:

a. a tubing string disposed within the well tubular;
b. means for longitudinally moving the tubing string within the well tubular;
c. a fluid motor attached to the extreme end of the tubing string within the well tubular;
d. means for supplying power fluid to the fluid motor;
e. cutter head means rotatably attached to the fluid motor whereby the cutter head means can be operated to remove deposits from the inside diameter of the well tubular; and
f. guide means attached to and extending downwardly from the cutter head means comprising a flexible drive shaft rotatably attached to and extending downwardly from the cutter head means and a universal joint connecting the flexible drive shaft to the guide means.

2. A system as defined in claim 1 wherein the longitudinal moving means comprises a coil tubing injector.

3. A system as defined in claim 2 wherein the power fluid supply means comprises:

a. the tubing string; and
b. a source of power fluid at the well surface.

4. A system as defined in claim 1 wherein the guide means further comprises:

a. means for centralizing the universal joint; and
b. serrations on the exterior of the guide means.

5. A system for cleaning for cleaning the inside diameter of well tubulars at a downhole location within a wellbore comprising:

a. a tubing string disposed within the well tubular;
b. means for longitudinally moving the tubing string within the well tubular;
c. a fluid motor attached to the extreme end of the tubing string within the well tubular;
d. means for supplying power fluid to the fluid motor;
e. a combination cutter and guide means rotatably attached to the fluid motor by a flexible hose extending downwardly therefrom whereby the cutter and guide means can be operated to remove deposits from the inside diameter of the well tubular; and
f. means for communicating via the flexible hose spent power fluid from the motor to the combination cutter and guide means.

6. A system as defined in claim 5 wherein the longitudinal moving means comprises a coil tubing injector.

7. A system as defined in claim 6 wherein the power fluid supply means comprises:

a. the tubing string; and
b. a source of power fluid at the well surface.

8. A system as defined in claim 5 wherein the combination cutter and guide means further comprises:

a. serrations on the exterior of the combination cutter and guide means;
b. a flow path through the combination cutter and guide means; and
c. ports to allow spent power fluid to exit from the combination cutter and guide means.

9. A system as defined in claim 8 wherein the exit ports of the combination cutter and guide means provide a jetting effect as spent power fluid exits therefrom.

10. A combination cutter and guide means for use with coil tubing and a fluid powered turbine motor attached thereto to remove downhole deposits from the inside diameter of a well flow conductor comprising:

a. a mandrel means with a flow path extending at least partially therethrough;
b. means for attaching the mandrel means to the turbine motor to allow fluid flow from the coil tubing via the turbine motor into the flow path;
c. a plurality of ports extending radially through the mandrel means to allow fluid communication with the flow path;
d. housing means disposed on the exterior of the mandrel means and covering the ports to form an annular chamber to receive fluid from the flow path; and
e. a plurality of openings formed in the housing means to allow fluid to exit the annular chamber on a tangent relative to the outer surface of the mandrel means.

11. A combination cutter and guide means as defined in claim 10 further comprising serrations carried on the exterior of the mandrel means.

12. A combination cutter and guide means as defined in claim 10 wherein the means for attaching the mandrel means to the turbine motor comprises a flexible hose.

* * * * *